United States Patent [19]

Landi

[11] Patent Number: 5,015,172

[45] Date of Patent: May 14, 1991

[54] METHOD AND APPARATUS FOR DETECTING SHORT CIRCUITED COMBUSTION AIR SWITCHES

[75] Inventor: William R. Landis, Bloomington, Minn.

[73] Assignee: Honeywell Inc., Minneapolis, Minn.

[21] Appl. No.: 303,605

[22] Filed: Jan. 27, 1989

[51] Int. Cl.[5] ..... F23N 5/22

[52] U.S. Cl. ..... 431/6; 431/90; 340/644

[58] Field of Search ..... 431/6, 24, 90; 340/644; 324/418; 236/94

[56] References Cited

U.S. PATENT DOCUMENTS

| | | | |
|---|---|---|---|
| 3,676,042 | 7/1972 | Osborne | 431/90 X |
| 3,756,221 | 9/1973 | Patycola | 431/90 X |
| 3,877,000 | 4/1975 | Kosco | 340/644 |
| 4,223,306 | 9/1980 | Reimer | 340/644 |
| 4,298,334 | 11/1981 | Clark et al. | 431/24 |
| 4,384,844 | 5/1983 | Yamamoto et al. | 431/14 |
| 4,399,537 | 8/1983 | Jones | 371/14 |
| 4,403,942 | 9/1983 | Copenhaver | 431/24 |
| 4,444,551 | 4/1984 | Mueller et al. | 431/25 |
| 4,459,099 | 7/1984 | Grunden et al. | 431/27 |
| 4,581,697 | 4/1986 | Jamieson et al. | 364/140 |

*Primary Examiner*—William E. Wayner
*Attorney, Agent, or Firm*—Edward Schwarz

[57] ABSTRACT

A method and apparatus detect a faulty air switch in a heating system which has an operation cycle comprising a plurality of operating periods. The air switch senses air flow in the heating system and causes air flow limit contacts to open when the air flow is outside a predetermined limit. The air flow is outside the predetermined limit during a first operating period of the operation cycle. A series circuit comprises the air flow limit contacts, coupled in series with other limit contacts between a limit sense terminal and an energized input terminal. The other limit contacts should be closed during the first operating period of the operation cycle. The limit sense terminal is sampled during the first operating period to determine whether the limit sense terminal is energized. Based on whether the limit sense terminal is energized, the air switch is determined to be faulty or operating properly.

24 Claims, 2 Drawing Sheets

METHOD AND APPARATUS FOR DETECTING SHORT CIRCUITED COMBUSTION AIR SWITCHES

BACKGROUND OF THE INVENTION

1. Field of the Invention

This invention relates to detecting faulty components in a heating system. More particularly, this invention relates to detecting a faulty combustion air switch in a heating system.

2. Description of the Prior Art

Forced air industrial heating systems, such as furnaces, ovens and boilers, typically have a blower or burner motor which forces air into a combustion chamber. There the air is combined with fuel and ignited. If not enough combustion air is blown into the combustion chamber, a fuel-rich environment results in the combustion chamber. The environment may become so fuel-rich that there is not enough air in the combustion chamber to support combustion. If insufficient combustion air is detected, uncombusted fuel and products of combustion will continue to build up in the combustion chamber; possibly creating an explosive, hazardous condition.

Therefore, it is necessary to have some type of combustion air detector for detecting whether sufficient combustion air flow is present for safe burner operation. Combustion air detector switches can be of several types including, among others, air pressure switches and sail switches.

In any case, these combustion air detectors are generally transducers which control a set of switch contacts which are wired to directly control power to fuel valves which supply fuel to the combustion chamber in the heating system. Therefore, when insufficient combustion air for safe, clean combustion is detected, power to the fuel valves is interrupted causing them to close. If the switch contacts controlled by the combustion air detection transducer are short-circuited, a loss of sufficient combustion air in the combustion chamber may never be detected and a fuel-rich, possibly hazardous environment may arise in the combustion chamber.

Heating system controllers sold in the United States are not required to test for the ability of the combustion air transducer controlled contacts to open. Therefore, only when a heating system operator specifically does so, are the contacts tested.

In Europe, on the other hand, the combustion air contacts are required to be tested. This test has typically required the contacts to have a single-pole double-throw (SPDT) construction. The normally closed contacts are tested prior to, or at the start of, a heating system's cycle for closure. If they are not closed, the heating system is not permitted to start. Then, when the combustion air detector is detecting adequate air in the combustion chamber, the normally open contacts are tested for closure. If these contacts are open, the heating system will be recycled or shut down.

Although this test does typically detect short-circuited contacts, the SPDT contacts add cost to the heating system. They add cost to the combustion air detection switch, to the controller controlling the heating system, and to the field wiring required for installation.

Another method which has been used to test for the ability of the combustion air contacts to open is to designate a specific input terminal to the controller to monitor the contacts. However, this method also adds cost to the controller and takes up controller inputs.

Therefore, there is a need for a method and apparatus which tests for the ability of combustion air contacts to open without requiring the contacts to be of SPDT construction or to have a dedicated input terminal to the controller.

SUMMARY OF THE INVENTION

A method and apparatus detect a faulty air switch in a heating system having an operation cycle comprising a plurality of operating periods where the air switch senses air flow in the heating system and causes air flow limit contact means to open when the air flow is outside a predetermined limit. The air flow is outside the predetermined limit during a first operating period of the operating cycle. A series circuit comprises the air flow limit contact means coupled in series with other limit contact means between a limit sense terminal and an energized input terminal. The other limit contact means should be closed during the first operating period of the operation cycle. The limit sense terminal is sampled during the first operating period of the operation cycle before a combustion air blower has established sufficient air flow or pressure to close the air switch, to determine whether the limit sense terminal is energized. If it is energized, the burner cannot continue. The limit sense terminal is again sampled after sufficient time has elapsed for the combustion air switch to close; the burner is shut down if the limit sense terminal is not energized.

DETAILED DESCRIPTION OF THE PREFERRED EMBODIMENTS

Figure 1:
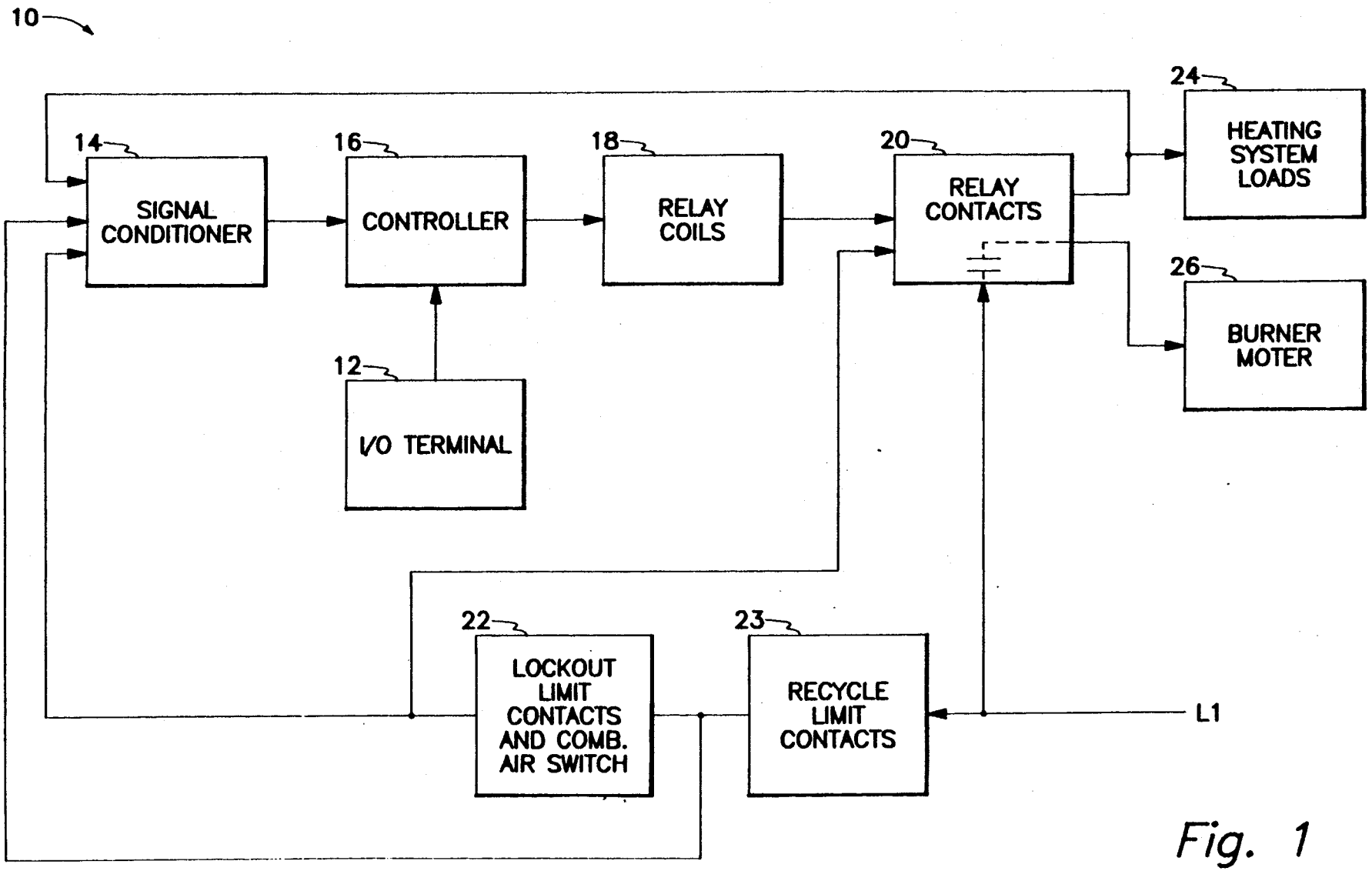
FIG. 1 is a block diagram of a heating system.

FIG. 1 is a block diagram of heating system 10 which includes I/O terminal 12, signal conditioner 14, controller 16, relay coils 18, relay contacts 20, transducer controlled recycle limit contacts 23, tranducer controlled lockout limit contacts 22, heating system loads 24 and burner motor 26. A heating system operator inputs various commands at I/O terminal 12. Based on those commands as well as status signals from relay contacts 20, and recycle limit contacts 23, (all of which are conditioned at signal conditioner 14) controller 16 commands various outputs and provides them to relay coils 18. Based on those outputs, relay coils 18 control the closure of relay contacts 20.

Line voltage L1 is provided, through recycle limit contacts 23 and lockout limit contacts 22, to one side of relay contacts 20 and if any of relay contacts 20 are commanded to close by relay coils 18, the line voltage is applied to corresponding heating system loads 24. The burner motor 26 obtains its power from a point upstream of limits 22 and 23. For example, if a heating system operator desires to turn on heating system 10 and enters proper commands at I/O terminal 12, controller 16 commands outputs to relay coils 18 which close relay contacts 20 corresponding to fuel valves which provide fuel to a combustion chamber in heating system 10. Also, the relay contacts 20 corresponding to burner motor 26, which provides combustion air to the combustion chamber in heating system 10, and an ignitor, which ignites the fuel and air mixture in the combustion chamber of heating system 10 are closed.

Various parameters are sensed by heating system transducers such as fuel pressure and temperature, combustion air flow or pressure and, water temperature or steam pressure. It is desired that when some of the sensed parameters are out of limits, certain heating system loads 24, such as fuel valves, should be de-energized and human intervention should be required to re-energize them. Therefore, the transducers which sense these parameters control closure of lockout limit contacts 22. When one of the lockout limit transducers sense that a parameter is out of limits, one of limit contacts 22 opens breaking the circuit applying line voltage L1 to certain relay contacts 20 thereby de-energizing certain heating system loads 24.

The state of lockout limit contacts 22 is also fed back to controller 16 through signal conditioner 14. This ensures that controller 16 can command a safe sequence of events once any of lockout limit contacts 22 signal an out-of-limits condition. Additionally, this arrangement prevents reclosure of limit contacts 22 from directly re-energizing certain fuel valve and ignition loads which could cause unsafe operation as a result of these loads being rapidly energized or deenergized.

State signals representing the state of certain relay contacts 20 and lockout limit contacts 22 are fed back to signal conditioner 14 which converts the state signals into logic signals which represent the presence or absence of line voltage at a monitored node. Also, various sensor outputs (such as solid state fuel pressure sensors) are fed back to signal conditioner 14 where they are conditioned and provided to controller 16. Based on these logic signals, controller 16 determines which relay contacts 20 are open and closed and if any limit contacts 22 or 23 or solid state sensors are signalling an out-of-limit condition.

Figure 2:
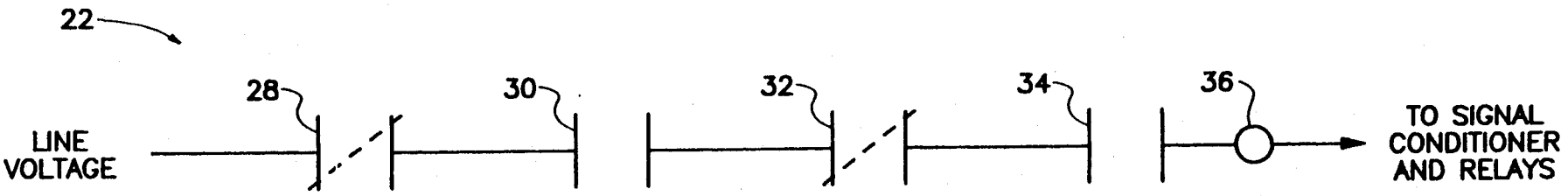
FIG. 2 is a schematic diagram of various limit contacts.

FIG. 2 shows one preferred embodiment of lockout limit contacts 22. Several transducer controlled contacts are shown. FIG. 2 includes, for example, fuel pressure contact 28, blower motor starter interlock contact 30, oil temperature contact 32 and normally open combustion air detection contact 34 (collectively referred to as lockout limit switches 28, 30, 32 and 34). When the fuel pressure reaches a high out-of-limit value, fuel pressure contact 28 opens. Since fuel pressure limits normally do not open at anytime during a burner sequence, fuel pressure contact 28 is normally closed at all times.

Interlock contact 30 is a contact which closes when the blower motor in heating system 10 is energized. Contact 30 is normally open during the off-period of heating system 10.

Normally closed oil temperature contact 32 opens when heating system 10 is using oil as fuel and when the oil temperature is out-of-limits. During the off-period of heating system 10, contact 32 is also normally closed.

Combustion air detection contact 34 operates based on the presence or absence of sufficient combustion air in heating system 10. When sufficient combustion air is being supplied by burner motor 26, combustion air detection contact 34 closes. Therefore, combustion air detection contact 34 is normally open during the off-period of heating system 10 since no air flow is detected.

Lockout limit switches 28 and 32 are normally closed during the off-period of heating system 10. However, combustion air detection contact 34 and interlock contact 30 are normally open during the off-period of heating system 10. Therefore, to test combustion air detection contact 34 for a short-circuit, controller 16 powers relay coils 18 which closes a relay contact pair 20 to power burner motor 26. This action closes interlock contacts 30. Then, controller 16 samples node 36 to determine the presence or absence of line voltage during the brief time period between the energization of burner motor 26 and the time when combustion air detection contacts are supposed to close. If line voltage L1 is present at node 36 during this short period of operation of heating system 10, then contact 34 is short-circuited and the short-circuit is detected.

At the beginning of the off-period, burner motor 26 is still turning and may be providing enough combustion air to the combustion chamber to cause combustion air detection contact 34 to remain closed. Therefore, controller 16 must schedule the off-period of heating system 10 to be long enough to allow the speed of burner motor 26 to decrease to a point where combustion air detection contact 34 opens and controller 16 has time to sample node 36. If, for some reason, one of limit switches 28, 30 or 32 is open because of an out-of-limit condition, that will be detected by controller 16 when it tests for closure of contact 34.

Figure 3:
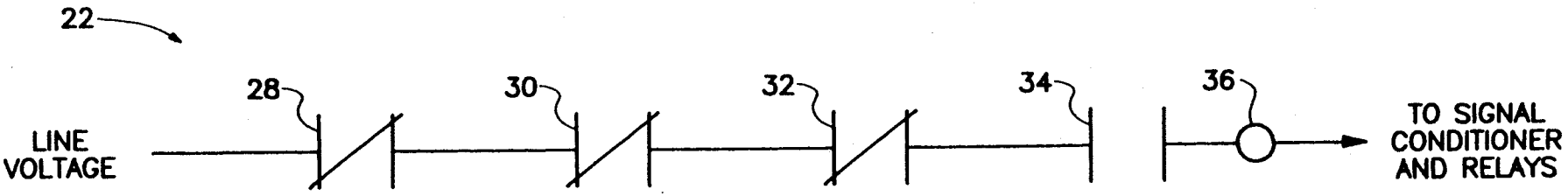
FIG. 3 is a schematic diagram of various limit contacts.

FIG. 3 shows lockout limit contacts 22 of FIG. 2 immediately after controller 16 has commanded an on-period. Contact 30 immediately closes upon the issuance of an on-period command by controller 16. However, burner motor 26 takes some period of time to generate enough air flow so that the combustion air detection transducer detects sufficient combustion air in the combustion chamber of heating system 10. Therefore, there is some time delay between the time when lockout limit switch 30 closes and the time when combustion air detection contact 34 closes. For this reason, controller 16 tests combustion air detection contact 34 for a short circuit by sampling node 36 during the time interval after contact 30 closes and before contact 34 closes. If line voltage appears at node 36 during that interval, then combustion air detection contact 34 is short circuited and that will be detected.

If burner motor 26 had recently been turned off, it may still be turning when it is reenergized during the start-up period of heating system 10. In that case, burner motor 26 takes less time to cause closure of combustion air detection contact 34 than if burner motor 26 were starting from a stopped position. Therefore, controller 16 must impose a minimum time between on-periods of heating system 10 not only to allow the speed of burner motor 26 to decrease to a point where combustion air detection contact 34 opens, but so that there is enough time for controller 16 to sample node 36 before burner motor 26 reaches a speed sufficient to cause the combustion air detection contact 34 to close.

If all of lockout limit contacts 22 connected in series with contact 34 were normally closed during the off-period of heating system 10 (for example, if interlock contact 30 were not connected in series with contact 34), combustion air detection contact 34 would be tested in a manner similar to that described above (when any of lockout limit contacts 22 are normally open during the off-period of heating system 10). However, controller 16 would merely sample node 36 during the off-period of heating system 10 rather than immediately after the burner motor is energized. As in the previous case, burner motor 26 must be off long enough for combustion air detection contact 34 to open.

CONCLUSION

In arranging limit contacts 22 in this manner, the need for a single-pole double-throw contact arrangement for combustion air detection contact 34 vanishes. This reduces equipment and installation costs. Additionally, since more than one limit contact is wired in series with combustion air detection contact 34, there is no need to reserve a specific input to monitor operation of the combustion air detection switch and its corresponding contact.

Additionally, since combustion air detection contact 34 is proven both open and closed, there is no possibility of a heating system operator by-passing both contact pairs in a SPDT combustion air switch arrangement.

Although the present invention has been described with reference to preferred embodiments, workers skilled in the art will recognize that changes may be made in form and detail without departing from the spirit and scope of the invention.

What is claimed is:

1. A method for detecting a faulty air switch in a heating system having an operation cycle comprising a plurality of operating periods where the air switch senses air flow in the heating system and causes air flow limit contact means to open when the air flow is outside a predetermined limit and where the air flow is outside the predetermined limit during a first operating period of the operation cycle, the method comprising the steps of:

providing a series circuit including the air flow limit contact means in series with other limit contact means, between a limit sense terminal and an energized input terminal where the other limit contact means should be closed during the first operating period of the operation cycle; and sampling the limits sense terminal during the first operating period of the operation cycle to determine whether the limit sense terminal is energized.

2. The method of claim 1 and further comprising the step of:

shutting down the heating system if the limit sense terminal is energized when sampled during the first operating period.

3. The method of claim 2 and further comprising the step of:

sampling the limit sense terminal during a second operating period when the air flow limit contact means should be closed and when the other limit contact means should be closed to monitor the other limit contact means.

4. The method of claim 1 wherein the plurality of operating periods comprises an off-period, an on-period and a start-up period where the air flow is outside the predetermined limit during the off-period and during the start-up period.

5. The method of claim 4 wherein the other limit contact means are normally open during the off-period and should close at the start of the start-up period.

6. The method of claim 5 wherein the step of sampling the limit sense terminal during the first operating period is performed during the start-up period while the other limit contact means should be closed and before the airflow limit contact means should close.

7. The method of claim 1 wherein the plurality of operating periods comprises an off-period and an on-period wherein the air flow is outside the predetermined limit during the off-period.

8. The method of claim 7 wherein the other limit contact means are normally closed during the off-period.

9. The method of claim 8 wherein the step of sampling the limit sense terminal during the first operating period is performed during the off-period.

10. An apparatus for detecting a faulty air switch in a heating system having an operation cycle comprising a plurality of operating periods where the air switch senses air flow in the heating system and causes air flow limit contact means to open when the air flow is outside a predetermined limit and where the air flow is outside the predetermined limit during a first operating period of the operation cycle, the improvement comprising:

a series circuit including the air flow limit contact means in series with other limit contact means, between a limit sense terminal and an energized input terminal, where the other limit contact means should be closed during the first operating period of the operation cycle; and sampling means for sampling the limit sense terminal during the first operating period of the operation cycle to determine whether the limit sense terminal is energized.

11. The apparatus of claim 10 and further comprising:

shutdown means for shutting down the heating system if the limit sense terminal is energized when sampled during the first operating period.

12. The apparatus of claim 11 and further comprising:

limit sampling means for sampling the limit sense terminal during a second operating period when the air flow limit contact means should be closed and when the other limit contact means should be closed to monitor the other limit contact means.

13. The apparatus of claim 10 wherein the plurality of operating periods further comprises:

an off-period during which the air flow is outside the predetermined limit;

a start-up period during which the air flow is outside the predetermined limit; and an on-period.

14. The apparatus of claim 13 wherein the other limit contact means are normally open during the off-period and ould close at the start of the start-up period.

15. The apparatus of claim 14 wherein the sampling means samples the limit sense terminal during the start-up period while the other limit contact means should be closed and before the airflow limit contact means should close.

16. The apparatus of claim 10 wherein the plurality of operating periods comprises:

an off-period during which the air flow is outside the predetermined limit; and an on-period.

17. The apparatus of claim 16 wherein the other limit contact means are normally closed during the off-period.

18. The apparatus of claim 17 wherein the sampling means samples the limit sense terminal during the off-period.

19. A method for detecting a faulty air switch in a heating system having a cycle comprising an off-period, a start-up period, and an on-period where the air switch senses air flow in the heating system and causes air flow limit contact means to open when the air flow is outside a predetermined limit and where the air flow is outside the predetermined limit during the off-period and during the start-up period, the method comprising the steps of:

providing a series circuit including the air flow limit contact means in series with other limit contact means between a limit sense terminal and an energized input terminal, the other limit contact means being normally open during the off-period of the heating system; and sampling the limit sense terminal during the start-up period of the heating system to determine whether the limit sense terminal is energized.

20. The method of claim 19 and further comprising the step of:

shutting down the heating system if the limit sense terminal is energized.

21. The method of claim 20 and further comprising the step of:

sampling the limit sense terminal during the on-period to test the other limit contact means.

22. An apparatus for detecting a faulty air switch in a heating system having a cycle comprising an off-period, a start-up period, and an on-period where the air switch senses air flow in the heating system and causes air flow limit contact means to open when the air flow is outside a predetermined limit and where the air flow is outside the predetermined limit during the off-period and during the start-up period, the apparatus comprising:

a series circuit including the air flow limit contact means in series with other limit contact means between a limit sense terminal and an energized input terminal, the other limit contact means being normally open during the off-period of the heating system and closing after the off-period of the heating system; and sampling means for sampling the limit sense terminal during the start-up period of the heating system to determine whether the limit sense terminal is energized.

23. The apparatus of claim 22 and further comprising:

shut-down means for shutting down the heating system if the limit sense terminal is energized.

24. The apparatus of claim 23 and further comprising:

sampling means for sampling the limit sense terminal during the on-period to test the other limit contact means.

* * * * *